United States Patent [19]

Johnson

[11] Patent Number: 4,627,541

[45] Date of Patent: Dec. 9, 1986

[54] APPARATUS AND METHOD FOR SORTING PRODUCE

[75] Inventor: Lynn F. Johnson, American Falls, Id.

[73] Assignee: Double L Manufacturing, American Falls, Id.

[21] Appl. No.: 688,744

[22] Filed: Jan. 4, 1985

[51] Int. Cl.[4] ..... B07B 1/14

[52] U.S. Cl. ..... 209/668; 209/394; 209/673

[58] Field of Search ..... 209/660, 667, 668, 673, 209/393, 394; 193/35 C

[56] References Cited

U.S. PATENT DOCUMENTS

| | | | |
|---|---|---|---|
| 3,348,679 | 10/1967 | Russell | 209/545 |
| 3,367,494 | 2/1968 | Peterson | 209/668 |
| 3,848,741 | 11/1974 | Haley et al. | 209/668 |
| 4,148,398 | 4/1979 | Mustikka | 209/668 |
| 4,291,808 | 9/1981 | Roloff | 209/668 |
| 4,405,050 | 9/1983 | Fenton, Jr. et al. | 209/668 |

FOREIGN PATENT DOCUMENTS

| | | | |
|---|---|---|---|
| 7507606 | 6/1975 | Netherlands | 209/673 |

OTHER PUBLICATIONS

Advertisement, "Spudnik's New Potato Sorter/Dirt Eliminator", date unknown.

*Primary Examiner*—Robert B. Reeves
*Assistant Examiner*—Donald T. Hajec
*Attorney, Agent, or Firm*—Workman, Nydegger & Jensen

[57] ABSTRACT

A roller conveyor for automatically sorting produce or other items according to size which includes an apparatus and method for hydraulically adjusting the space between the rollers to permit optional uniformly graduated increments or fixed spacing between each pair of rollers. Each roller of the conveyor is slidably mounted at opposite ends of the roller to a frame. The ends of each roller are supported in a bearing block and each adjacent pair of rollers is interconnected at the ends of the roller by a slidable connecting rod attached between the bearing blocks of the adjacent rollers. The spacing between the rollers is hydraulically controlled by using a series of hydraulic cylinders which are operated in tandem to selectively inject hydraulic fluid into the bearing blocks so as to cause the connecting rods to slide the rollers further apart, or in the alternative to cause hydraulic fluid to be expelled from the bearing blocks and to drive the slidable connecting rods closer together so that the rollers will be spaced more closely.

47 Claims, 9 Drawing Figures

APPARATUS AND METHOD FOR SORTING PRODUCE

BACKGROUND

1. Field of the Invention

This invention relates to apparatus and methods used for sorting produce or other items according to size, and more particularly to an apparatus and method for hydraulically adjusting the space between the rollers on a conveyor to permit optional uniformly graduated increments or fixed spacing between each pair of rollers.

2. The Prior Art

In many industries there is a need to automatically sort items according to size. For example, in the agricultural industry, one common method for sorting objects according to size is to place the objects on a conveyor which consists of a series of rollers. The surface of the rollers and the slope or incline at which the conveyor is placed permits the various items of produce placed on the conveyor to be transferred from one end of the conveyor to the other. Depending upon the size of the space between each pair of rollers, produce which is a certain size and smaller will fall through the spaces between the rollers, whereas larger items of produce will continue to be carried by the rollers to the end of the conveyor. In this manner, the roller conveyor automatically sorts the produce according to size.

In order to be able to change the size of produce which is permitted to drop through the roller conveyor, there is a need to be able to adjust the space between rollers. The ability to adjust the spacing between rollers is important because it permits the conveyor to be used for a much wider variety of products, as well as permitting the conveyor to be used for sorting various sizes of a particular product. There have been several attempts in the art to address this particular need.

One attempt which has been made in the prior art involves the use of a frame which is used to support the rollers, and providing on the frame a series of holes which can be selected for each roller. Each roller is then secured to the frame by placing a bolt through the selected hole and then securing the bolt with a nut. By providing a series of holes the location of each roller can be changed as desired so that spacing between rollers can be increased or decreased to permit sorting of larger or smaller items, as needed. While this particular methods works for purposes of permitting the conveyor to be adjusted and used for sorting different sizes, the disadvantage of this method is that there is a good deal of manual labor involved in having to undo and resecure each individual roller. Thus, it is very time consuming and inconvenient, as well as creating costly downtime in order to make the needed adjustments.

Another approach which has been used in the art to vary the spacing between rollers is to provide coil springs which are compressed between each pair of adjacent rollers. By increasing the distance between the first and the last rollers on the conveyor, the coil springs will automatically expand the distance between all adjacent rollers so as to increase the space between them. While this particular approach permits more rapid adjustment when increasing or decreasing the space between adjacent rollers, it has the disadvantage that the space between each pair of rollers will be uniform. In some circumstances, it is desirable to have different size spaces between the roller at opposite ends of the conveyor so that smaller items will be sorted at one end of the conveyor while somewhat larger items will be sorted at the other end of the conveyor. Another disadvantage of this approach is that items can get caught between the rollers, forcing them apart. This results in nonuniform sorting.

PRINCIPAL OBJECTS AND BRIEF SUMMARY OF THE INVENTION

In view of the present state of the art, it is a principal object of the present invention to provide an improved apparatus and method for quickly and accurately adjusting the space between rollers of a conveyor so as to permit items of differing sizes to be sorted as they are carried by the conveyor.

Another important object of the invention is to provide an apparatus and method for hydraulically adjusting the space between the rollers of a conveyor so that the rollers can be either automatically adjusted all at once so as to fix the space between the rollers in graduated increments or in uniformly spaced distances or so that the rollers can be individually adjusted.

Still another important object of the present invention is to provide an apparatus and method for adjusting the space between the rollers of a conveyor in a manner so as to firmly and rigidly hold the rollers in place once the spacing between the rollers has been adjusted.

Yet another object of the present invention is to provide an apparatus and method for adjusting the space between rollers of a conveyor without having to stop the conveyor and without having to make manual adjustments.

Still a further object of the present invention is to provide an apparatus and method for adjusting the space between rollers on a conveyor wherein the mechanism for adjusting the space between each pair of rollers is relatively free from becoming clogged by dirt or other debris as produce is carried by the conveyor.

These and other objects of the present invention will become more readily apparent from the drawings, detailed descriptions and claims.

Briefly summarized, in accordance with the foregoing objects, the present invention comprises an apparatus and method for hydraulically adjusting the space between each pair of adjacent rollers on a conveyor. By using a series of hydraulic cylinders which are operated in tandem, each roller on the conveyor can be hydraulically actuated so as to simultaneously increase or decrease the space between each pair of adjacent rollers. The spacing between each pair of adjacent rollers can be uniform, or it can be graduated so that the spacing between adjacent rollers at one end of the conveyor is smaller than the spacing between adjacent rollers at the other end of the conveyor, thus permitting objects of several different sizes to be simultaneously sorted as they travel on the conveyor. The adjustment in spacing between the rollers can be easily and quickly accomplished using a single mechanism which simultaneously adjusts each of the hydraulic cylinders used to actuate the spacing between the rollers, or it can be accomplished individually for each pair of rollers. The entire apparatus is easy to maintain and operate, and effectively overcomes the problems which have heretofore existed in the prior state of the art.

FIGS. *2a* and *2b* are enlarged perspective views which schematically illustrate in greater detail the manner in which the present invention can be hydraulically actuated to selectively decrease the spacing between a pair of adjacent rollers as illustrated in FIG. *2a*, or to selectively increase the spacing between adjacent rollers as illustrated in FIG. *2b*.

FIG. *2c* is a cross-sectional view taken along line *2c*—*2c* in FIG. *2a*.

FIGS. *3a*–*3d* are plan views which schematically illustrate the manner in which the hydraulic cylinders of the apparatus can be operated to vary the spacing between adjacent rollers of the conveyor so that the spacing between the rollers can be uniformly minimized, as shown in FIG. *3a*, or uniformly maximized as shown in FIG. *3b*, or so that the spacing between rollers can be fixed in nonuniform increments as illustrated in FIG. *3c* or *3d*.

Figure 4:
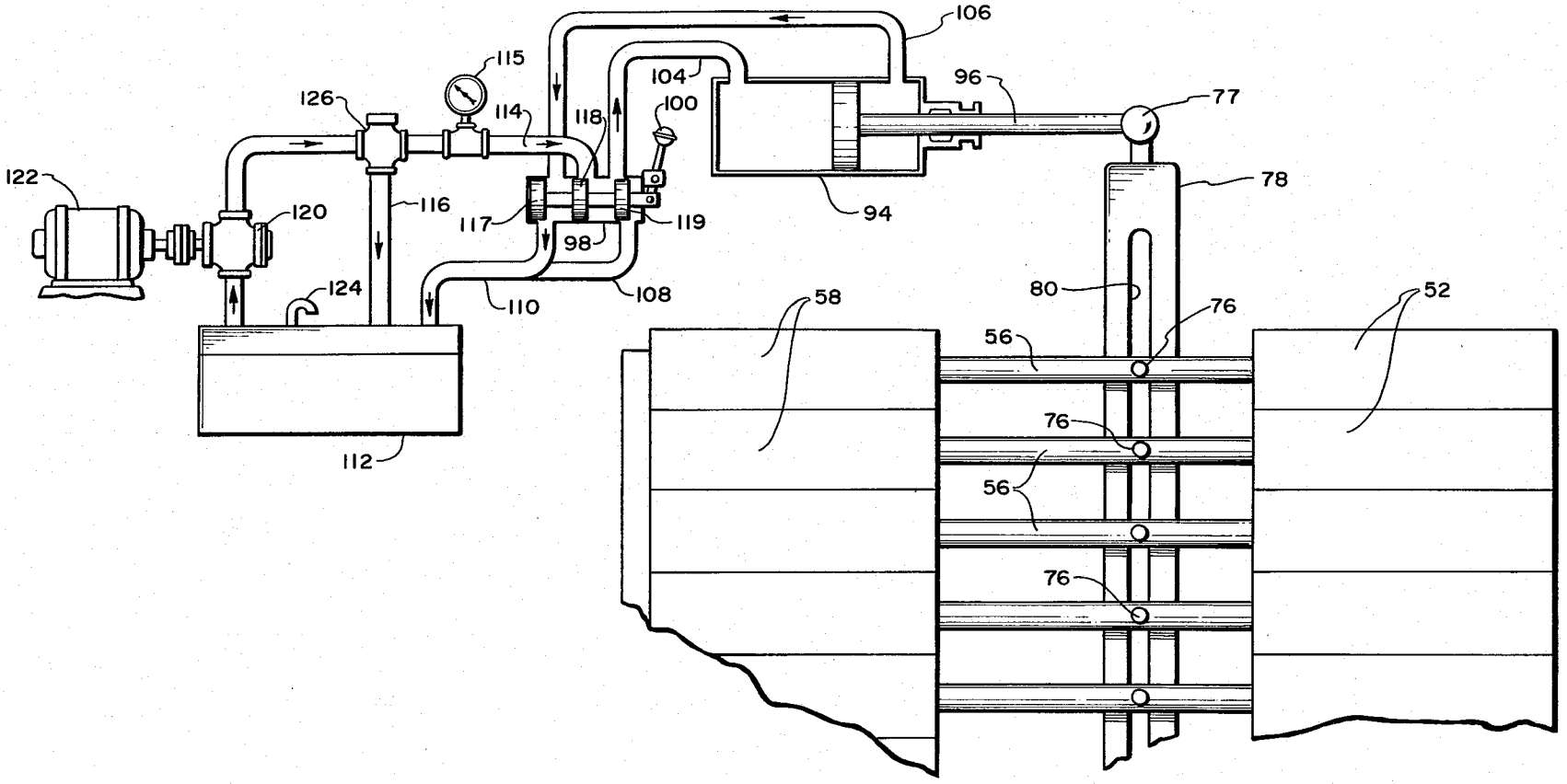

FIG. 4 is a schematic block diagram which illustrates one presently preferred apparatus for controlling the slotted drive rod which actuates each bank of hydraulic cylinders in tandem.

DETAILED DESCRIPTION OF THE PRESENTLY PREFERRED EMBODIMENT

Reference is next made to a detailed description of the drawings, wherein like parts are designated with like numerals throughout. Reference is first made to a description of the structure of the apparatus of the present invention, which is then followed by a description of the manner in which the apparatus can be operated in accordance with the presently preferred method of the invention.

1. The Apparatus

It will be appreciated that the apparatus of the present invention may be used for sorting any of a number of different types of items. A typical application for the apparatus of this invention would be its use in connection with sorting produce such as potatoes or other vegetables according to size. The description which follows will make reference to use of the apparatus of this invention for purposes of sorting such produce; however, it should be understood that the apparatus may be used equally well in other applications.

Figure 1:
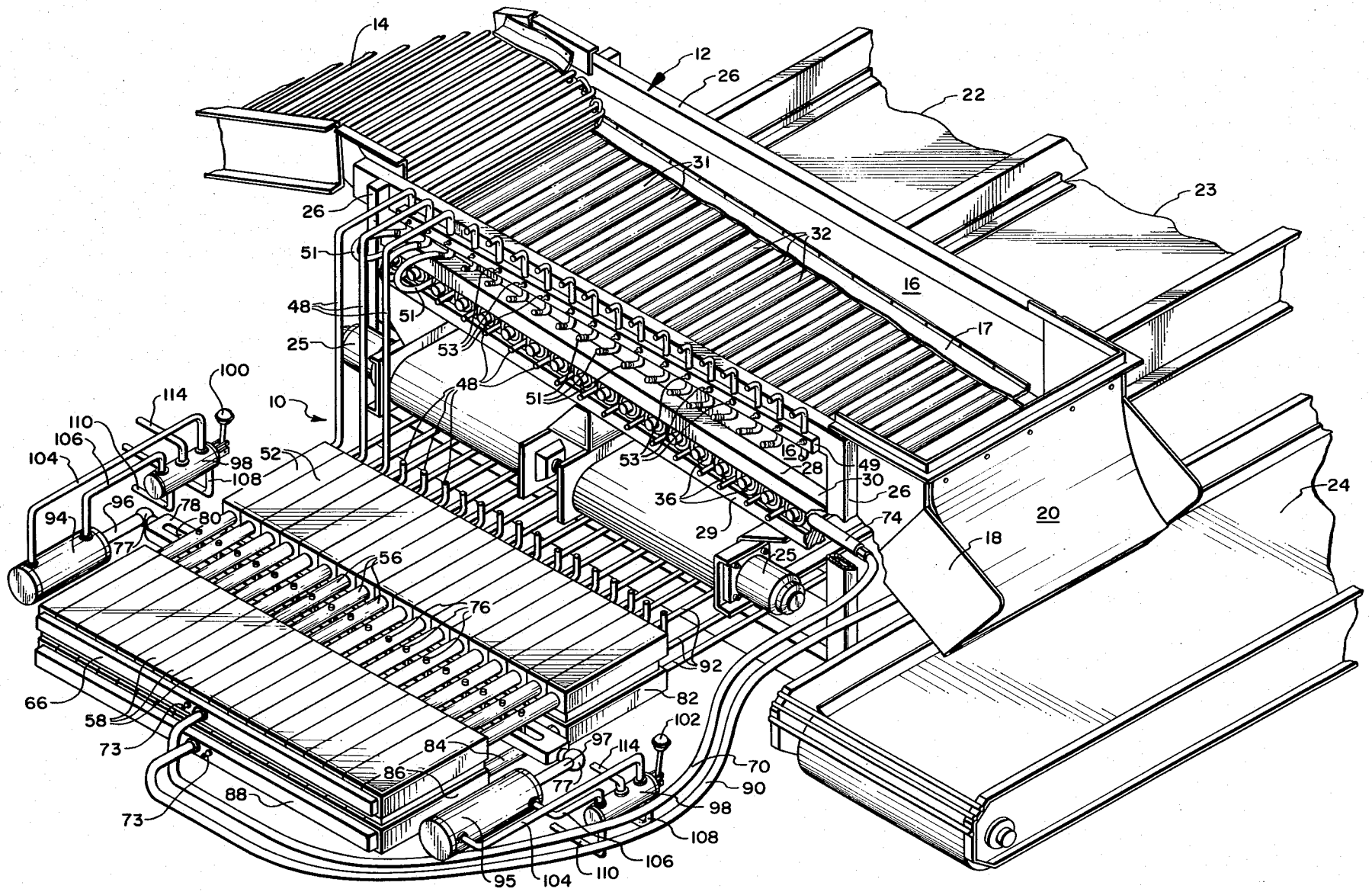
FIG. 1 is a perspective view which schematically illustrates one presently preferred embodiment of the apparatus of the present invention.

Referring first to FIG. 1, the apparatus is generally designated at 10. The apparatus includes a roller conveyor generally designated at 12 and comprising a series of rollers 32 which are supported on a frame 26 and which are mounted between upright sides 16. Produce may be introduced onto the roller conveyor 12 by means of a conveyor 14 positioned at one end thereof. The produce is then transported between the upright sides 16 to the other end of the roller conveyor 12 where it exits from a chute 18 which is provided with a flap 20 so that the produce will be gently deposited onto another conveyor 24 positioned beneath the chute 18.

As hereinafter more fully explained, as the produce is transported from one end of the roller conveyor 12 to the other, produce which is of a selected size or smaller will fall through the spaces 31 between the rollers 32 and will be collected on the conveyors 22 and 23 which are positioned beneath the roller conveyor 12, and which are each driven by a motor 25. In this manner, as the items are transported on the roller conveyor 12 they are automatically separated according to size. As hereinafter more fully explained, the apparatus of the present invention advantageously provides the option for simultaneously sorting items of three or more different sizes. Thus, produce of a certain grade or size can be collected on conveyor 22, produce of a second grade or size can be collected on conveyor 23 and produce of yet another grade or size can be collected on conveyor 24. It will be appreciated that the number of different sizes that can be simultaneously sorted using the apparatus of the present invention can be varied without departing from the essential characteristics of the invention.

With further reference to FIG. 1, the ends of rollers 32 are supported between two essentially horizontal side members 28 and 29 which are attached to a supporting frame 26. One end of the side members 28 and 29 can be raised or lowered so as to cause the roller conveyor 12 to slope from one end to the other. A cover strip 17 is placed along the longitudinal edge of each upright side 16 to protect the ends of the rollers 32 from becoming covered or clogged with dirt or other debris which may tend to fall through the spaces 31 between the rollers 32.

The manner by which the ends of each roller 32 are secured between the members 28 and 29 is best illustrated with reference to FIGS. *2a* and *2b*. Each end 42 of the shaft of each roller 32 is secured in a bearing block 36. Each bearing block 36 is provided with grooves 33 at the top and bottom of the block so that the bearing block 36 can be slidably mounted on tracks 34 and 35 which are formed as part of the support members 28 and 29 of the frame 26. Thus, bearing blocks 36 which support the ends 42 of each roller shaft are designed to slide along the tracks 34 and 35 so as to permit the spacing 31 (see FIG. 1) between each adjacent pair of rollers 32 to be easily adjusted.

With reference again to FIG. 1, the apparatus of the present invention includes two upper banks of hydraulic cylinders 52 and 58 and two lower banks of hydraulic cylinders 82 and 86. The upper banks of hydraulic cylinders 52 and 58 are each coupled by a series of corresponding piston rods 56, whereas the lower banks of hydraulic cylinders 82 and 86 are each coupled by corresponding piston rods 84. The upper piston rods 56 and the lower piston rods 84 are in turn each connected by pins 76 which fit through the slot 80 of a drive rod 78. The ends of drive rod 78 are in turn connected by ball joints 77 to the piston rods 96 and 97 of hydraulic drive cylinders 94 and 95. As hereinafter more fully described, the hydraulic drive cylinders 94 and 95 are used to actuate the drive rod 78 so that the piston rods 56 and 84 for each bank of upper and lower hydraulic cylinders 52, 58, 82 and 86 will be operated in tandem.

The upper bank of hydraulic cylinders 52 are each connected through a separate hydraulic drive line 48 to a manifold 49 mounted on frame 26. Preferably, each drive line 48 is constructed of metal tubing so that unwanted variations in the pressure of the hydraulic fluid delivered to the manifold 49 will be minimized. As shown best in FIG. *2c*, manifold 49 has a channel 65 which provides fluid communication between each corresponding drive line 48 and connecting line 51. Each drive line 48 is connected to a separate channel 65 of manifold 49. Each channel can also be individually accesed through a spring-loaded ball valve 53 which comprises a ball 67 (FIG. *2c*) held by spring 69. Thus, as described further below, each bearing block 36 can be individually hydraulically actuated by introducing hydraulic fluid into the channel 65 through the ball valve 53.

Connecting lines 51 are provided by short lengths of rubber tubing which connect each drive line 48 and channel 65 to one of the bearing blocks 36 on one end of the roller conveyor 12. The lower bank 82 of hydraulic cylinders are each connected through a corresponding hydraulic fluid line 92 to a manifold 49 and through connecting lines to the bearing blocks 36 (see FIGS. *3a–3d*) on the other side of the roller conveyor 12. As shown best in FIGS. *2a–2b*, the hydraulic drive lines 48 are connected to the upper bank of hydraulic cylinders 52 by means of a fitting 50 which provides fluid communication with a bore 54 provided at the interior of each cylinder 52. The hydraulic cylinders 82 (see FIG. 1) of the lower bank are similarly connected to drive lines 92. An interior bore 38 is provided inside each bearing block 36. Each bore 38 is adapted to slidably receive the leading end 43 of a connecting rod 40 which is positioned between a pair of adjacent bearing blocks 36. The other trailing end (not shown) of each connecting rod 40 is nonslidably secured in the end of the bore 38 of the other adjacent bearing block 36.

As hydraulic fluid is forced into the bore 38, the leading end 43 of each connecting rod which is positioned in the bearing block 36 will be forced outwardly thereby causing each bearing block 36 to slide along the tracks 34 and 35 so as to move them apart. In a corresponding fashion, as hydraulic fluid is expelled from the bore 38 the leading end 43 of each connecting rod 40 moves further toward the center of each bore 38 so that the bearing blocks 36 slide together.

With further reference to FIG. *2b*, the end connecting rod 41 is slidably received in a corresponding end cylinder 74 which has a bore 76 through the center of the cylinder 74. The end cylinder 74 is connected through a fitting 72 to a hydraulic drive line 70 which is connected at the other end through a fitting 68 to a manifold 66 which runs along the length of the bank of hydraulic cylinders 58. The manifold 66 has a chamber 64 for receiving hydraulic fluid and the chamber 64 communicates through a small bore 62 provided in each cylinder 58 with the interior bore 60 of each cylinder 58. As shown in FIGS. 1 and *3a–3d*, the lower bank of cylinders 84 have a similarly constructed manifold 88 that is connected by hydraulic drive line 90 to the end cylinder 74 (see FIGS. *3a–3d*) on the other side of conveyor 12.

As hereinafter more fully described, by controlling the position of the slotted drive rod 78, the piston rods 56 and 84 between each upper bank of cylinders 52 and 58 and each lower bank of cylinders 82 and 86 can be operated in tandem. Thus, as shown for example in FIG. *2a*, when the slotted drive rod 78 is positioned so that the piston rods 56 are fully extended into the cylinders 58, hydraulic fluid will be forced through drive line 70 into the end cylinder 74. The hydraulic fluid forced into the bore 76 of end cylinder 74 will in turn urge the end rod 41 further into the bore 38 of bearing block 36. The leading end 43 of each connecting rod 40 will in turn be urged further into the corresponding bore 38 of each bearing block 36 so that hydraulic fluid will be forced from each bore 38 through the connecting lines 51 and drive lines 48 back into the bore 54 of each corresponding cylinder 52. The bearing blocks 36 will then slide along tracks 34 and 35, moving them closer together.

If the slotted drive rod 78 is positioned as shown in FIG. *2b* so that the rods 56 are fully extended into cylinders 52, hydraulic fluid will be forced through each drive line 48 and connecting line 51 into each chamber 38 of each bearing block 36. This will cause the leading ends 43 of the connecting rods 40 to be forced outwardly, thereby causing the bearing blocks 36 to move apart as they slide along tracks 34 and 35. The end rod 41 will be extended into the bore 76 of end cylinder 74, and hydraulic fluid will be forced through line 70 back to the chamber 64 of manifold 66, and then into the bore 60 of each cylinder 58.

With reference again to FIG. 1, it will be appreciated that the two lower banks of hydraulic cylinders 82 and 86 will be simultaneously actuated in a corresponding fashion by virtue of drive lines 92 and 90 which are connected in a similar fashion (see FIGS. *3a–3d*) to the bearing blocks 36 and end cylinder 74 which are provided on the other side of the roller conveyor 12. Since pins 76 connect the upper and lower piston rods 56 and 84, each bank of upper and lower hydraulic cylinders will be simultaneously operated by movement of the slotted drive rod 78. Accordingly, the connecting rods 40 on both sides of the conveyor assembly will be actuated simultaneously by movement of the slotted drive rod 78 so that the bearing blocks 36 on both sides of the conveyor will move simultaneously in the same direction and the same distance.

In the alternative, the apparatus and method of the present invention also permit each roller 32 to be individually hydraulically actuated without affecting the other rollers 32. This can be accomplished using the individual ball valves 53 which are provided on manifold 49 (shown best in FIGS. *2a–2c*). As previously described, manifold 49 has a separate channel 65 which connects each drive line 48 with each connecting line 51. Each ball valve 53 may be used to separately access the channel 65 which connects each drive line 48 and connecting line 51. Thus, by connecting a grease gun (not shown) to one of the valves 53, hydraulic fluid may be injected into a single bearing block 36. Since the drive rod 78 holds each piston rod 56 and 84 in place, only the end connecting rod 41 will be permitted to move. Thus, while fluid pressure in lines 70 or 90 may increase, only a single roller 32 will be permitted to move. The fittings 46 which connect each connecting line 51 to the bearing blocks 36 can be loosened so that hydraulic fluid will be permitted to escape from a single bearing block. Hydraulic fluid can then be injected through ball valves 73 into the manifolds 66 and 88 if it is desired to move an individual roller 32 closer to the next adjacent roller. Accordingly, each roller 32 can, in this manner, be spaced either further from or closer to an adjacent roller without affecting any other roller in the conveyor.

Each adjacent pair of rollers 32 has a slide bar 55 (see FIGS. *2a* and *2b*) rigidly connected by a pin 61 to one bearing block 36, while the other end of slide bar 55 has a slot 59 which engages a pin 57 connected to an adjacent bearing block 36. The slide bar 55 limits the maximum distance by which each pair of adjacent bearing blocks 36 may be separated so as to prevent the leading end 43 of connecting rod 41 from being pulled out of the bore 38 of bearing block 36, as shown in best in FIG. *2b*.

In the presently preferred embodiment, the slotted drive rod 78 is actuated hydraulically by means of the hydraulic left and right drive cylinders 94 and 95 (see FIGS. 1 and 4). It will be appreciated by those of ordinary skill in the art that there are a number of means by which the slotted drive rod 78 may be actuated. In the presently preferred embodiment, the hydraulic left and right drive cylinders 94 and 95 are used. However, motor-driven screw mechanisms or other similar types of positioning mechanisms could be used to move the ends of the slotted drive rod 78 in the manner hereinafter more fully described.

The manner by which the left and right hydraulic drive cylinders 94 and 95 are operated is conventional in the art, and is best illustrated with reference to the schematic diagram of FIG. 4. Each drive cylinder, as for example cylinder 94, is connected through two hydraulic drive lines 104 and 106 to a four-way directional control valve 98. The control valve 98 is in turn connected through hydraulic line 114 to a constant volume pump 120 which is driven by an electric motor 122. Hydraulic fluid is pumped from reservoir 112 through the hydraulic line 114 to control valve 98. A relief valve 126 is connected in the hydraulic line 114 and is provided with an auxiliary fluid line 116 so that if the pressure in the hydraulic line 114 exceeds a safe level, relief valve 126 is opened so as to permit fluid to be returned to the reservoir 112. A pressure gauge 115 may also be positioned in the hydraulic line 114. Control valve 98 is also connected through return lines 108 and 110 to fluid reservoir 112.

By operating the control lever 100 the piston heads 117–119 of the control valve 28 can be positioned so as to force fluid to enter cylinder 94 through line 104, at the same time causing the hydraulic fluid to exit from the other side of the piston 96 through line 106 so as to be returned through line 110 to reservoir 112. In this mode, the piston rod 96 will be extended. Control lever 100 can be moved in the opposite direction so that hydraulic fluid will be forced to enter the cylinder 94 through line 106, at the same time causing hydraulic fluid to exit cylinder 94 through line 104 and back through line 108 to reservoir 112. In this mode, the piston rod 96 will be retracted.

As hereinafter more fully described, each of the hydraulic drive cylinders 94 and 95 may be independently actuated so that the ends of drive rod 78 may be positioned independent of one another. As shown in FIG. 4, the piston rod 96 of each drive cylinder is connected by a ball joint 77 so that the opposite ends of the slotted drive rod 78 can be pivoted with respect to each other. As described in more detail below, this provides added flexibility in the manner in which the rollers 32 can be spaced from one another.

Reference is next made to FIGS. 3*a*–3*d* which illustrate in more detail the preferred method of operating the apparatus in accordance with the method of the present invention.

2. The Method

Figures 2A, 2C:
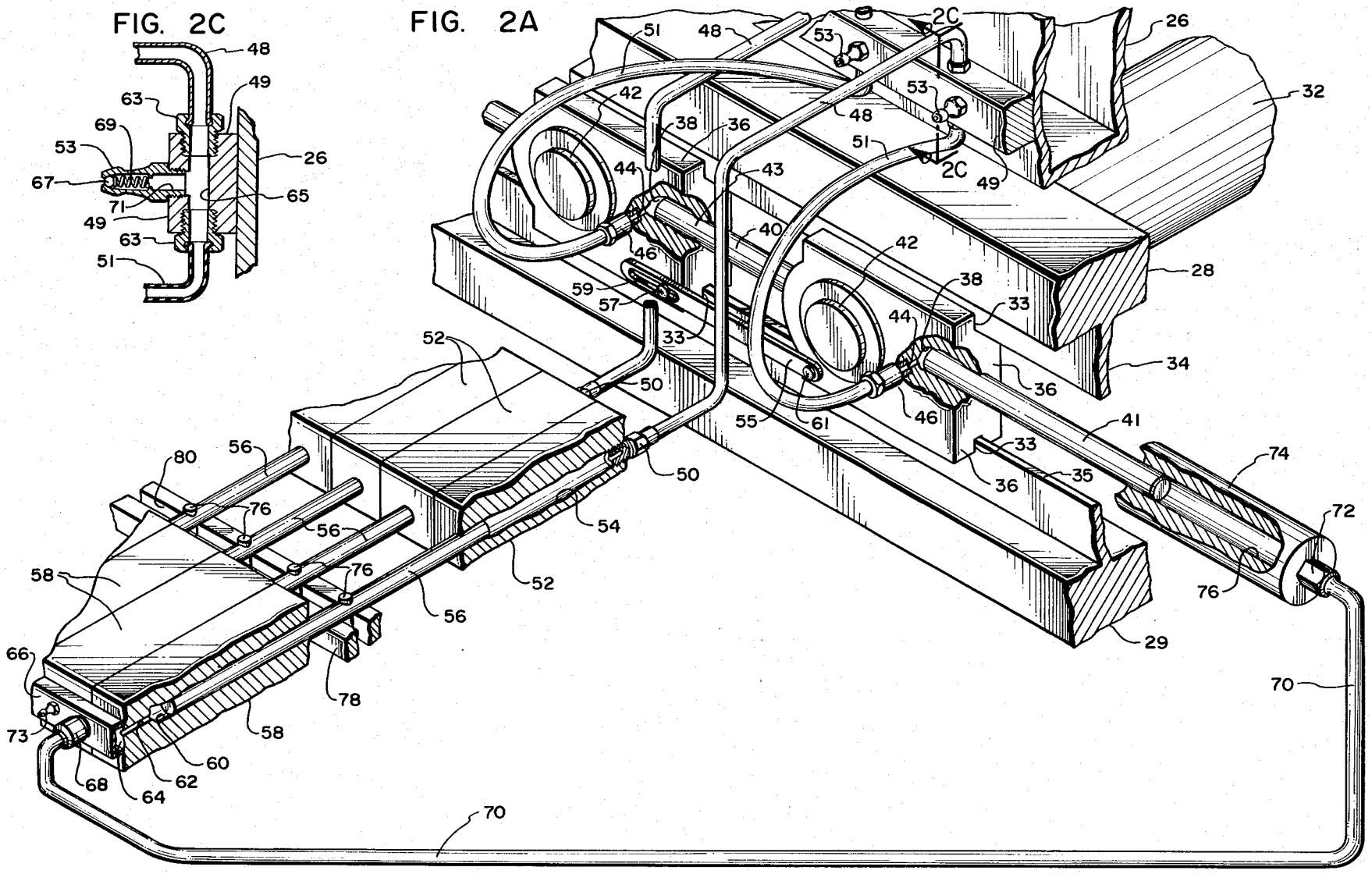
Figure 3A:
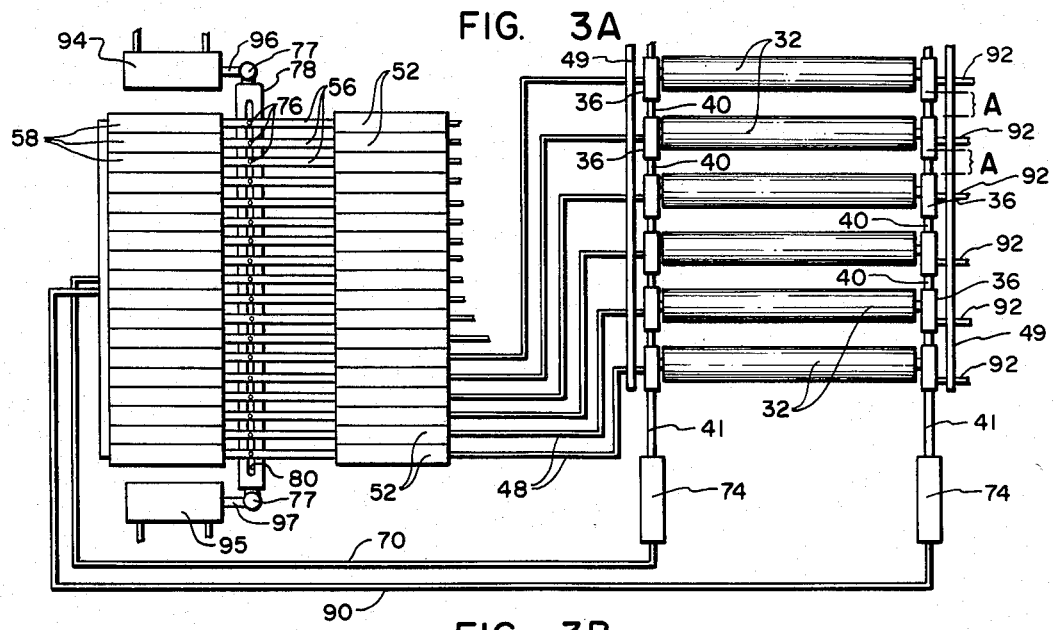

With reference first to FIG. 3*a*, when the left and right hydraulic drive cylinders 94 and 95 are actuated so as to fully retract the piston rods 96 and 97, the slotted drive rod 78 will exert a force on the connecting pins which will pull the upper and lower piston rods 56 and 84 to the rear so that each rod 56 and 84 will be fully extended into the rear bank of upper and lower cylinders 58 and 86. In this position, hydraulic fluid will be forced through drive lines 70 and 90 to end cylinders 74, and each end rod 41 and connecting rod 40 will be inserted further into the bearing blocks 36 as illustrated in FIG. 2*a*, causing the spacing between the rollers 32 to be uniformly decreased. As illustrated in FIG. 3*a*, the spacing, schematically indicated at A, will be at a minimum and will be uniform between each adjacent pair of rollers 32.

Figure 2B:
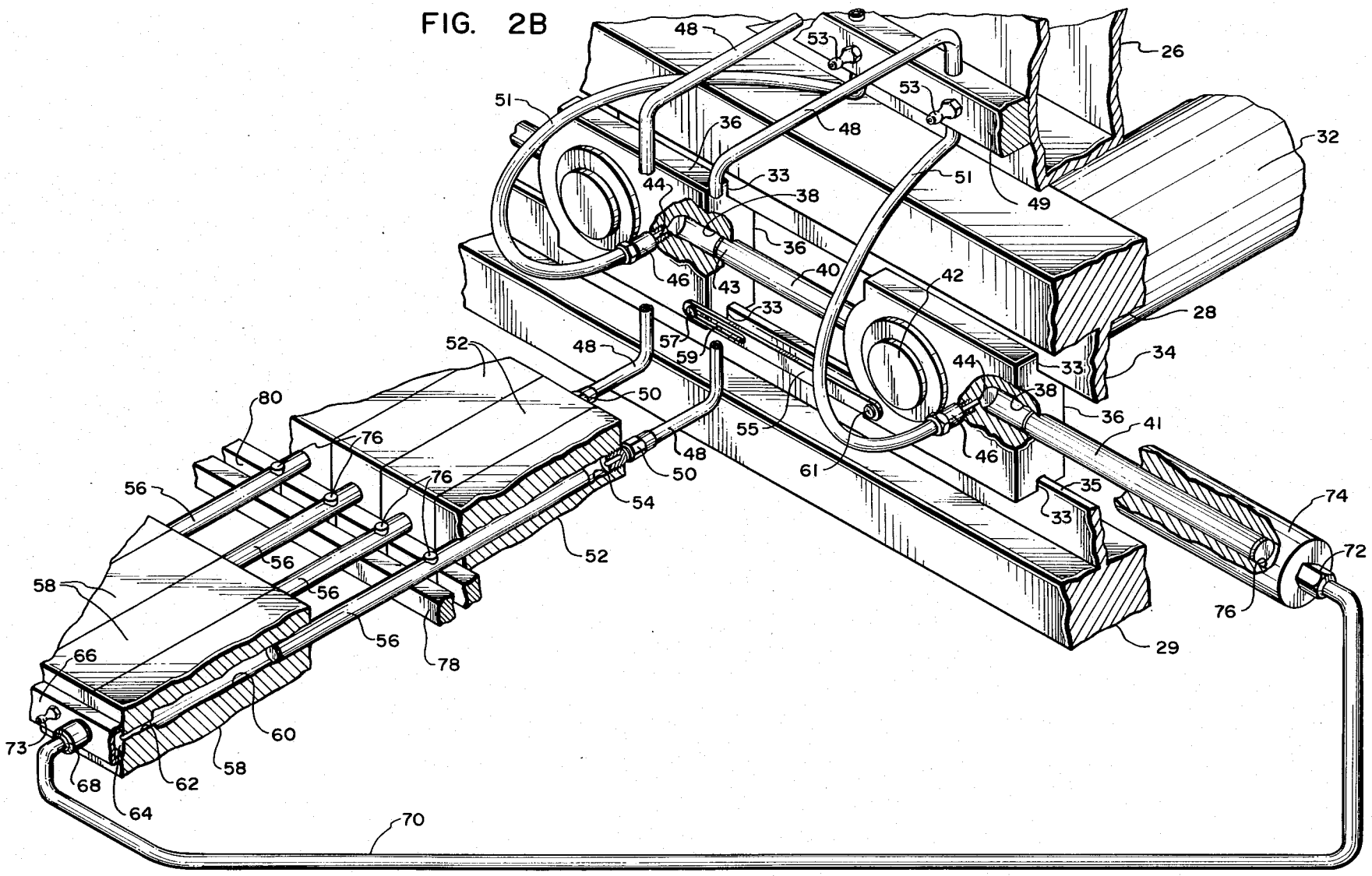
Figure 3B:
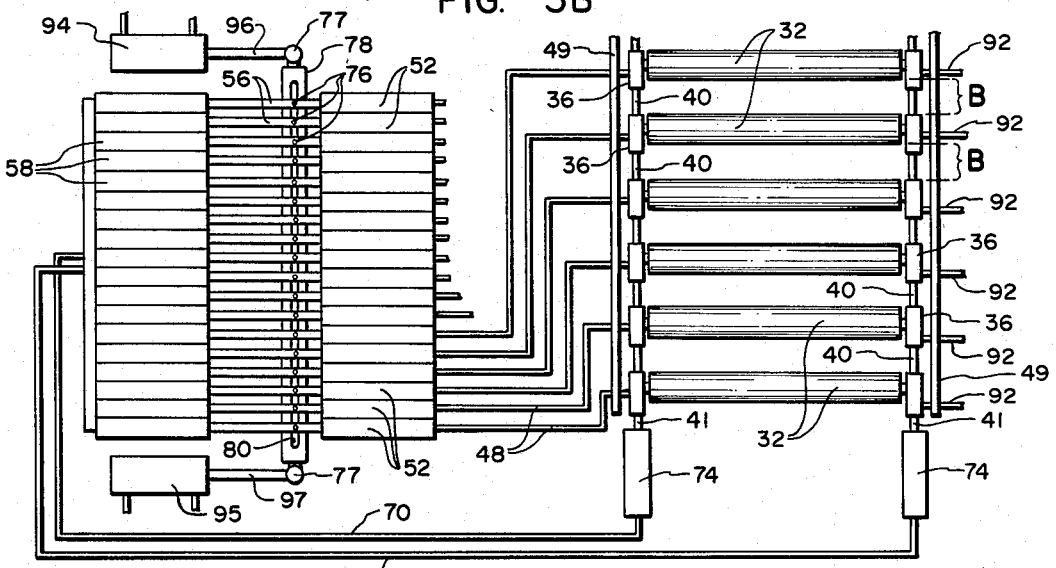

As shown in FIG. 3*b*, when the left and right drive cylinders 94 are actuated so as to fully extend the piston rods 96 and 97, the slotted drive rod 78 will be moved forward so as to fully extend the upper and lower rods 56 and 84 into the forward bank of upper and lower cylinders 52 and 82 while retracting the rods 56 and 84 from the rear bank of cylinders 58 and 84. In this position, hydraulic fluid will be forced through drive lines 48 and 92 into the bearing blocks 36, causing each connecting rod 40 to urge the bearing blocks 36 farther apart as described in FIG. 2*b*. Thus, as illustrated in FIG. 3*b*, the space B between each adjacent pair of rollers 32 will be uniformly increased to the maximum distance permitted by the slide bar 55 between each adjacent pair of rollers 32.

Figure 3C:
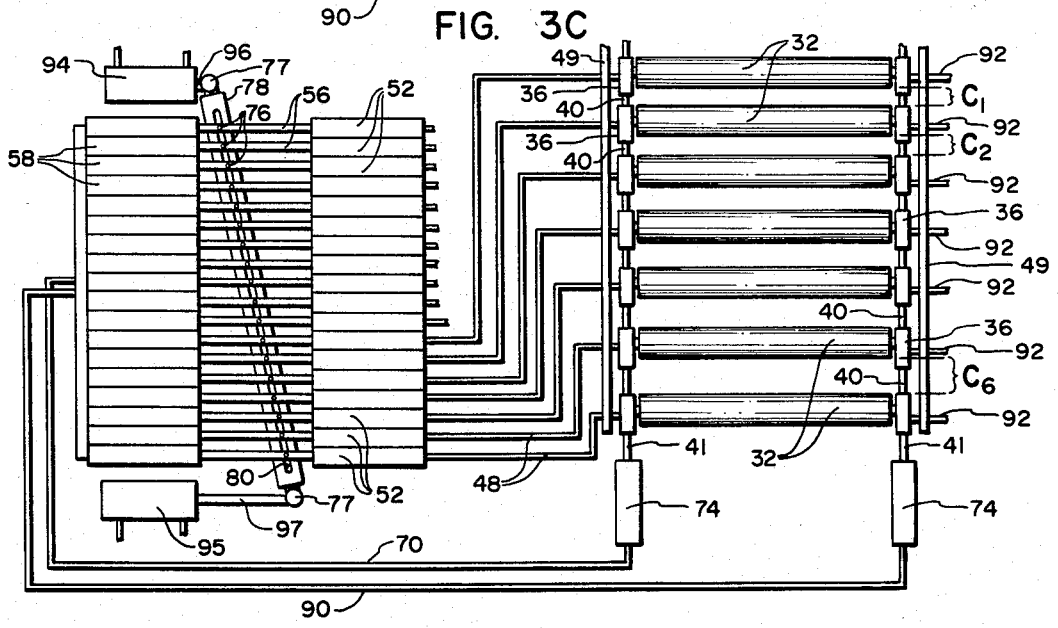

Significantly, as illustrated in FIG. 3*c*, the apparatus of the present invention may be operated in a manner so as to permit the space between each adjacent pair of rollers 32 to be automatically fixed in uniformly graduated increments so that the space C1 at one end of the roller conveyor 12 will be at a minimum while the space C6 at the other end of the roller conveyor 12 will be at a maximum, with the intervening spaces C2, C3 etc. uniformly increasing in width. This may be accomplished by independently actuating the hydraulic drive cylinders 94 and 95. As illustrated in FIG. 3*c* the piston rod 96 of left drive cylinder 94 is fully retracted. At the same time the piston rod 97 of the right drive cylinder 95 is fully extended. In this manner the ends of drive rod 78 may be independently positioned to impart varying degrees of motion to the piston rods 56 and 84. Thus, more hydraulic fluid is injected into the bearing blocks 36 at one end of conveyor 12 than at the other, resulting in the uniformly increasing spaces. This provides the significant advantage that items of several different sizes can be sorted at the same time. Thus, with reference to FIG. 1, when the apparatus is operated in accordance with the method as illustrated in FIG. 3*c*, smaller items will drop through the spaces 31 onto the first conveyor 22 whereas items which are slightly larger will be dropped through the spaces 31 at the other end of the conveyor onto a second receiving conveyor 23, while the largest items which are transported to the end of the roller conveyor 12 will exit through the chute 18 onto yet a third receiving conveyor 24. As may be appreciated, any number of receiving conveyors 22–24 could be provided in accordance with the method of this invention.

Figure 3D:
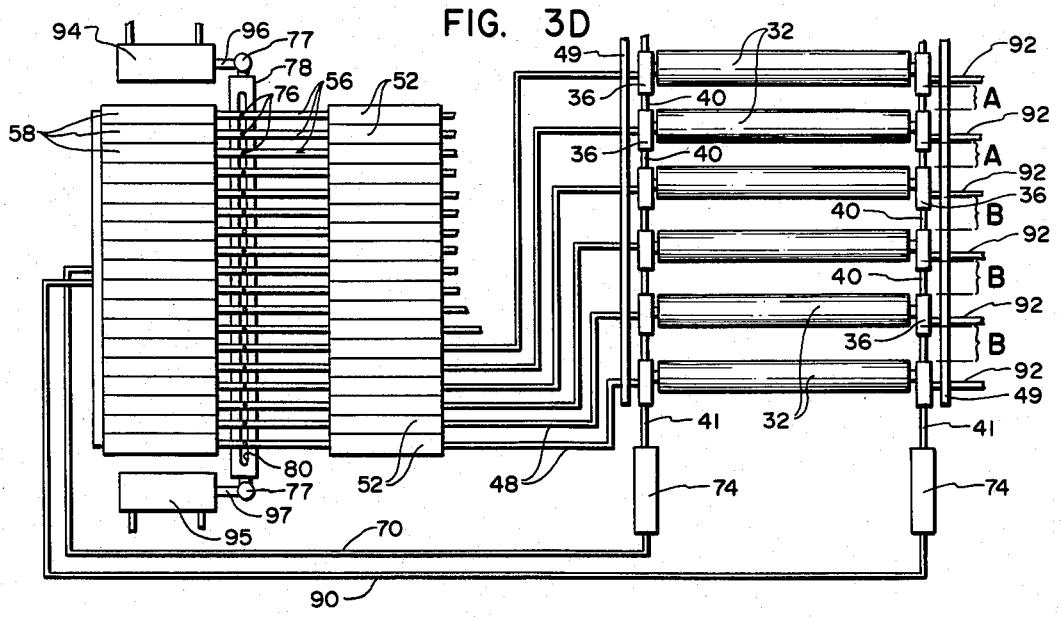

Still another method of operating the apparatus of the present invention is illustrated in FIG. 3*d*. In FIG. 3*d*, it will be noted that the spacing between adjacent rollers at one end of the conveyor may be set so that the spacing between adjacent rollers corresponds to a first distance A, whereas the spacing between adjacent pairs of rollers at the other end of the conveyor may be set at a second uniform distance B. This may be accomplished by individually spacing the rollers 32 using a grease gun to individually hydraulically actuate each separate roller 32 using the ball valves 53 provided on the manifold 49 for each side of the conveyor. Accordingly, the rollers 32 on one end of the conveyor may be spaced by a first uniform distance such as illustrated at A while the rollers at the other end of the conveyor may be spaced by a second uniform distance such as illustrated at B.

Unlike other types of prior art roller conveyors which are used for sizing produce, the apparatus of this invention is entirely hydraulically actuated so that the moving parts are enclosed and are thereby protected from dirt or other debris. This renders the apparatus easier to maintain over prolonged use. The apparatus further provides the advantage that the spacing between adjacent rollers on the conveyor can be very quickly and accurately adjusted so as to provide not only one or more sizes of uniform spacing but also uniformly graduated spacing in any desired degree between adjacent rollers. The spacing can be automatically adjusted without expensive manual labor and without causing expensive downtime.

It will be appreciated that the invention may be embodied in other forms without departing from its spirit or essential characteristics, and all changes coming within the meaning and range of equivalency of the described embodiment are to be embraced within the scope of the claims.

What is claimed and desired to be secured by U.S. Letters Patent is:

1. An apparatus for sorting products according to size comprising:

a roller conveyor for transporting products placed on said roller conveyor from one end thereof to the other, said roller conveyor comprising a plurality of rollers; and individual hydraulic means associated with each said roller for hydraulically controlling the position of each said roller so as to individually control the spacing between each pair of adjacent rollers such that the spacing between pairs of adjacent rollers is selectively adjustable in one of a plurality of modes, the modes comprising (a) adjusting all of the rollers at once by a uniform amount, (b) adjusting all of the rollers at once by uniformly increasing or decreasing the spacing between adjacent rollers from one end to the other, and (c) adjusting the spacing between one pair of rollers independently of the spacing between any other pair of rollers, whereby products of a selected size and smaller will drop through the spaces between said rollers while larger products will be transported to the end of said roller conveyor.

2. An apparatus as defined in claim 1 wherein said roller conveyor further comprises a frame having a pair of side members on opposite sides of said roller conveyor and wherein said individual hydraulic means comprises:

a bearing block mounted at each end of each said roller on opposite sides of said roller conveyor, each said bearing block comprising means for slidably engaging said side members such that said bearing blocks can be slidably positioned along said side members; and means for hydraulically actuating each said bearing block so as to cause said bearing blocks to be selectively positioned either closer together or farther apart.

3. An apparatus as defined in claim 2 wherein each said bearing block further comprises an interior bore formed therein for receiving hydraulic fluid, and wherein said means for hydraulically actuating each said bearing block comprises a connecting rod positioned between each adjacent pair of bearing blocks such that one end of said connecting rod is slidably positioned inside the interior bore of one of said adjacent bearing blocks, and the other end of said connecting rod is nonslidably engaged in the interior bore of the other said adjacent bearing block.

4. An apparatus as defined in claim 2 wherein said means for hydraulically actuating each said bearing block further comprises first means for actuating the bearing blocks on one side of said roller conveyor and second means for hydraulically actuating the bearing blocks on the other side of said roller conveyor.

5. An apparatus as defined in claim 4 wherein said first and second means each comprise:

a first bank of hydraulic cylinders, each said cylinder of said first bank being connected through a hydraulic drive line to one of said bearing blocks on one side of said conveyor;

a second bank of hydraulic cylinders, each hydraulic cylinder of said second bank being connected to a corresponding cylinder of said first bank by a piston rod;

a hydraulic drive line being connected at one end thereof to a manifold providing fluid communication between said cylinders of said second bank, and being connected at the other end thereof to an end cylinder comprising an end connecting rod which slidably engages the end bearing block on said one side of said roller conveyor; and means for simultaneously controlling the position of each said piston rod such that as each piston rod moves in a first direction hydraulic fluid will be injected from said cylinders of said first bank through said hydraulic drive line connecting said cylinders of said first bank to said bearing blocks so that said connecting rods will be actuated to move said bearing blocks further apart, and such that as said piston rods are moved in a second direction opposite to said first direction hydraulic fluid will be injected through said hydraulic drive line interconnecting said manifold of the second bank of hydraulic cylinders to said end cylinder so that said end connecting rod and each connecting rod between said bearing blocks will expel hydraulic fluid from said bearing blocks back to the cylinders of said first bank, whereby said bearing blocks will be actuated to move closer together.

6. An apparatus as defined in claim 4 wherein said means for hydraulically actuating each said bearing block comprises means for simultaneously actuating said first and second means such that corresponding bearing blocks on each side of said roller conveyor will move the same distance and in the same direction.

7. An apparatus as defined in claim 5 wherein said means for simultaneously controlling the position of each said piston rod comprises a drive rod having a slot formed therein, and a pin connected at one end to each said piston rod and engaging at the other end said slot of said drive rod.

8. An apparatus as defined in claim 7 further comprising means for independently positioning the ends of said drive rod so as to impart varying degrees of motion to said piston rods.

9. An apparatus as defined in claim 1 wherein said individual hydraulic means comprises means for hydraulically actuating a single roller without actuating any other roller of said conveyor.

10. A roller conveyor for automatically sorting items according to size as said items are transported by said roller conveyor, comprising:

a frame having a plurality of rollers mounted to said frame and spaced one from the other, said rollers transporting a portion of said items as they roll across said rollers from one end of said conveyor to the other, and a second portion of said items being sorted as they drop through the spaces between said rollers;

individual hydraulic means associated with each said roller for hydraulically moving each said roller so as to position said rollers; and means for controlling said individual hydraulic means associated with each said roller so as to be able to simultaneously and automatically adjust the space between adjacent rollers in order to selectively increase or decrease the space between each pair of adjacent rollers such that the spacing between pairs of adjacent rollers is selectively adjustable in one of a plurality of modes, the modes comprising (a) adjusting all of the rollers at once by a uniform amount, (b) adjusting all of the rollers at once by uniformly increasing or decreasing the spacing between adjacent rollers from one end to the other, and (c) adjusting the spacing between one pair of rollers independently of the spacing between any other pair of rollers.

11. A roller conveyor as defined in claim 10 wherein said frame comprises side members at opposite sides of said roller conveyor, each said side member comprising track means for slidably supporting the ends of said rollers.

12. A roller conveyor as defined in claim 11 wherein said individual hydraulic means comprises:

a plurality of bearing means for supporting each end of each said roller, each said bearing means comprising means for slidably engaging said track means such that said bearing means may each be slidably positioned along said track means; and means for hydraulically actuating each said bearing means to selectively increase or decrease the space between each said bearing means.

13. A roller conveyor as defined in claim 12 wherein said means for hydraulically actuating each said bearing means comprises:

first means for selectively injecting hydraulic fluid into said bearing means;

second means for selectively expelling hydraulic fluid from said bearing means; and third means for slidably connecting each adjacent pair of said bearing means such that when hydraulic fluid is injected into said bearing means said means for slidably connecting said bearing means will urge said bearing means further apart, and such that when hydraulic fluid is expelled from said bearing means said means for slidably connecting said bearing means will force said bearing means to slide closer together.

14. A roller conveyor as defined in claim 13 wherein each said bearing means comprises a bearing block having a bore formed through the interior of said bearing block for receiving hydraulic fluid.

15. A roller conveyor as defined in claim 13 wherein said first means for injecting hydraulic fluid into said bearing means comprises:

a first bank of hydraulic cylinders wherein each said cylinder is connected through a hydraulic drive line to one of said bearing means on one side of said conveyor; and a second bank of hydraulic cylinders wherein each said cylinder of said second bank is connected through a hydraulic drive line to a bearing means on the other side of said conveyor.

16. A roller conveyor as defined in claim 13 wherein said second means for expelling hydraulic fluid from said bearing means comprises:

a first and a second bank of hydraulic cylinders, each said first and second bank of hydraulic cylinders comprising a manifold for providing fluid communication between the respective cylinders of each said bank;

first and second end cylinders each comprising an end connecting rod slidably engaged to a bearing means on each side of said conveyor at one end thereof; and a hydraulic drive line interconnected between said manifold of said first bank of hydraulic cylinders and said end cylinder at one side of said conveyor, and a second hydraulic drive line interconnected between the manifold of said second bank of hydraulic cylinders and the end cylinder at the other side of said conveyor.

17. A roller conveyor as defined in claim 14 wherein said third means for slidably connecting each adjacent pair of bearing blocks comprises a connecting rod having one end thereof slidably engaged in one of said adjacent bearing blocks, and having the other end thereof nonslidably mounted in the interior bore of the other adjacent bearing block.

18. A roller conveyor as defined in claims 15 or 16 further comprising means for simultaneously actuating each hydraulic cylinder of said first and second banks of hydraulic cylinders so that said first and second banks of hydraulic cylinders will be simultaneously actuated in the same manner so as to cause said bearing means on one side of roller conveyor to move the same distance and in the same direction as said bearing means on the other side of said roller conveyor.

19. A roller conveyor for automatically sorting items according to size as said items are carried by said conveyor, said roller conveyor comprising:

a plurality of rollers spaced one from the other, said rollers transporting a portion of said items from one end of said conveyor to the other as said items roll across said rollers, another portion of said items being automatically sorted according to size as they fall between the spaces between said rollers;

a frame comprising side members for supporting said rollers at the ends of said rollers;

bearing means for slidably mounting the ends of each said roller to said side members;

hydraulic connecting means associated with each pair of adjacent bearing means for adjustably spacing each pair of adjacent bearing means; and means for individually hydraulically actuating each said connecting means such that the spacing between each adjacent pair of bearing means is selectively adjusted in one of a plurality of modes to increase or decrease said spacing, said modes comprising (a) adjusting all of the rollers at once by a uniform amount, (b) adjusting all of the rollers at once by uniformly increasing or decreasing the spacing between adjacent rollers from one end to the other, and (c) adjusting the spacing between one pair of rollers independently of the spacing between any other pair of rollers.

20. A roller conveyor as defined in claim 19 wherein said side members each comprise track means for slidably engaging said bearing means, and wherein said bearing means comprise a plurality of bearing blocks mounted on opposite sides of said roller conveyor, each said bearing block comprising means for slidably engaging said track means so as to permit each said bearing means to be slidably positioned along said track means.

21. A roller conveyor as defined in claim 20 wherein each said bearing means further comprises a bore for receiving hydraulic fluid formed in the interior of said bearing means, and wherein said connecting means for adjustably spacing each pair of adjacent bearing means comprises a connecting rod slidably engaged between each adjacent pair of bearing blocks such that one end of each said connecting rod is slidably mounted inside the interior bore of one of said adjacent bearing blocks, and the other end of said connecting rod is nonslidably mounted in the interior bore of the other said adjacent bearing block.

22. A roller conveyor as defined in claim 21 wherein said means for hydraulically actuating each said connecting means comprises first means for hydraulically actuating each said connecting rod on one side of said roller conveyor, and second means for hydraulically actuating each said connecting rod on the other side of said roller conveyor.

23. A roller conveyor as defined in claim 22 wherein said first and second means each comprise:

a first bank of hydraulic cylinders, each said cylinder of said first bank being connected through a hydraulic drive line to one of said bearing blocks;

a second bank of hydraulic cylinders, each hydraulic cylinder of said second bank being connected to a corresponding cylinder of said first bank by a piston rod;

a hydraulic drive line, said drive line being connected at one end thereof to a manifold providing fluid communication between said cylinders of said second bank, and being connected at the other end thereof to an end cylinder comprising an end connecting rod which slidably engages an end bearing block on one side of said roller conveyor; and means for simultaneously controlling the position of each said piston rod such that as each piston rod moves in a first direction hydraulic fluid will be injected from said cylinders of said first bank through said hydraulic drive lines connecting said cylinders of said first bank to said bearing blocks on one side of said roller conveyor so that said connecting rods on said side of said roller conveyor will be actuated to move said bearing blocks further apart, and such that as said piston rods are moved in a second direction opposite to said first direction hydraulic fluid will be injected through said hydraulic drive line interconnecting said manifold of said second bank of hydraulic cylinders to said end cylinder on said side of said roller conveyor so that said end connecting rod and each connecting rod between said bearing blocks on said side of said conveyor will expel hydraulic fluid from said bearing blocks back to the cylinders of said first bank, whereby said bearing blocks on said side of said conveyor will be actuated to move closer together.

24. A roller conveyor as defined in claim 22 wherein said means for hydraulically actuating each said connecting means comprises means for simultaneously actuating said first and second means such that corresponding bearing blocks on each side of said roller conveyor will simultaneously move the same distance and in the same direction.

25. An apparatus as defined in claim 23 wherein said means for simultaneously controlling the position of each said piston rod comprises a drive rod having a slot formed therein, and a pin connected at one end to each said piston rod and engaging at the other end said slot of said drive rod.

26. An apparatus as defined in claim 25 further comprising means for independently positioning the ends of said drive rod so as to impart varying degrees of motion to said piston rods, whereby said spacing between each adjacent pair of bearing blocks may be uniformly increased.

27. An apparatus as defined in claim 19 wherein said means for hydraulically actuating each said connecting means comprises means for actuating a single said connecting means so as to actuate only one of said bearing means at a time.

28. A roller conveyor as defined in claim 19 wherein said means for hydraulically actuating each said connecting means comprises:

first means for selectively injecting hydraulic fluid into said bearing means such that when hydraulic fluid is injected into said bearing means said connecting means will urge said bearing means further apart; and second means for selectively expelling hydraulic fluid from said bearing means such that when hydraulic fluid is expelled from said bearing means said connecting means will force said bearing means to slide closer together.

29. A roller conveyor as defined in claim 28 wherein said first means for injecting hydraulic fluid into said bearing means comprises:

a first bank of hydraulic cylinders wherein each said cylinder is connected through a hydraulic drive line to one of said bearing means on one side of said conveyor; and a second bank of hydraulic cylinders wherein each said cylinder of said second bank is connected through a hydraulic drive line to a bearing means on the other side of said conveyor.

30. A roller conveyor as defined in claim 28 wherein said second means for expelling hydraulic fluid from said bearing means comprises:

a first and a second bank of hydraulic cylinders, each said first and second bank of hydraulic cylinders comprising a manifold for providing fluid communication between the respective cylinders of each said bank;

first and second end cylinders each comprising an end connecting rod slidably engaged to a bearing means on each side of said conveyor at one end thereof; and a first hydraulic drive line interconnected between said manifold of said first bank of hydraulic cylinders and said end cylinder at one side of said conveyor, and a second hydraulic drive line interconnected between the manifold of said second bank of hydraulic cylinders and the end cylinder at the other side of said conveyor.

31. A roller conveyor as defined in claims 29 or 30 further comprising means for simultaneously actuating each hydraulic cylinder of said first and second banks of hydraulic cylinders so that said first and second banks of hydraulic cylinders will be actuated in the same manner so as to cause said bearing means on one side of roller conveyor to move the same distance and in the same direction as said bearing means on the other side of said roller conveyor.

32. A roller conveyor for automatically sorting items according to size as said items are carried by said conveyor, said roller conveyor comprising:

a plurality of rollers spaced one from the other and adapted for transporting a portion of said items from one end of said conveyor to the other as said items roll across said rollers, another portion of said items being automatically sorted according to size as they fall between the spaces betwen said rollers;

a frame comprising side members for supporting said rollers at the ends thereof, each said side member comprising track means on which the ends of said rollers are slidably mounted;

a bearing block mounted at each end of each said roller so as to provide support for each said roller, each said bearing block having an interior bore therein for receiving hydraulic fluid and comprising means for slidably engaging said track means such that said bearing blocks may be slidably positioned along said track means;

a plurality of connecting rods slidably engaged between each adjacent pair of bearing blocks, and an end rod slidably engaged at each side of said conveyor to a bearing block positioned at the end of said roller conveyor; and first and second means for hydraulically actuating the bearing blocks on each side of said roller conveyor so as to control the position of said bearing blocks on said track means, each said means for hydraulically actuating the bearing blocks on one side of said roller conveyor comprising:

a first bank of hydraulic cylinders wherein each cylinder comprises an interior bore coupled through a hydraulic drive line to one of said bearing blocks such that hydraulic fluid may enter and exit the interior bore of each bearing block through said hydraulic drive line;

a second bank of hydraulic cylinders wherein each said cylinder comprises an interior bore, said second bank of hydraulic cylinders further comprising a manifold forming a fluid chamber in communication with the interior bore of each said cylinder in said second bank;

an end cylinder having an interior bore, said end rod at one side of said conveyor having one end thereof slidably mounted in the interior bore of said end cylinder and having the other end thereof slidably engaged in the interior bore of the end bearing block on one side of said roller conveyor;

a hydraulic drive line connected at one end thereof to said manifold of said second bank of cylinders, and connected at the other end thereof to said end cylinder;

a plurality of piston rods, each said piston rod being mounted between a corresponding pair of cylinders in said first and second banks of hydraulic cylinders such that one end of each said piston rod slidably engages the interior bore of a cylinder in said first bank and the other end of said piston rod slidably engages the interior bore of a corresponding cylinder in said second bank, each said piston rod being connected by a pin to a drive rod; and means for actuating said drive rod so as to simultaneously impart movement to said piston rods interconnected between said first and second banks of hydraulic cylinders, whereby actuation of said piston rods in one direction will force hydraulic fluid from the cylinders of said first bank into the interior bore of each said bearing block on one side of said conveyor so as to urge said connecting rods to slide said bearing blocks further apart, whereas actuation of said piston rods in the other direction will cause hydraulic fluid to be forced into said end cylinder such that said connecting rods will expel hydraulic fluid from said bearing blocks on said one side back to said cylinders of said first bank so as to cause said bearing blocks to move closer together.

33. A method for sorting products comprising the steps of:

placing said products on one end of a roller conveyor;

spacing a plurality of rollers on said conveyor so as to provide an open space between each pair of adjacent rollers;

transporting a first portion of said products from said one end of the conveyor to the other, a second portion of said products being automatically sorted as they drop through said spaces provided between each pair of adjacent rollers; and hydraulically actuating said rollers individually so as to adjust the size of each said open space in one of a plurality of modes, said modes comprising (a) adjusting all of the rollers at once by a uniform amount, (b) adjusting all of the rollers at once by uniformly increasing or decreasing the spacing between adjacent rollers from one end to the other, and (c) adjusting the spacing between one pair of rollers independently of the spacing between any other pair of rollers.

34. A method as defined in claim 33 wherein said step of hydraulically actuating said rollers comprises simultaneously moving said rollers by a uniform amount so that each said open space will be uniform in size.

35. A method as defined in claim 33 wherein said step of hydraulically actuating said rollers comprises hydraulically actuating one or more of said rollers one at a time.

36. A method as defined in claim 33 wherein said step of hydraulically actuating said rollers comprises simultaneously moving said rollers by a nonuniform amount so that said open spaces will change in size from one end of said roller conveyor to the other by a uniformly graduated increment.

37. A method as defined in claim 33 wherein said roller conveyor comprises a frame having side members on opposite sides of said frame and further comprising a pair of bearing blocks for supporting each said roller at opposite ends thereof, each said bearing block comprising means for slidably engaging said side members, and said roller conveyor further comprising a connecting rod slidably mounted between each pair of adjacent bearing blocks, and wherein said step of hydraulically actuating said rollers comprises the step of controlling the flow of hydraulic fluid into and out of said bearing blocks such that when hydraulic fluid is injected into said bearing blocks said connecting rods will urge said bearing blocks further apart, and such that when hydraulic fluid is expelled from said bearing blocks said connecting rods will force said bearing blocks to move closer together.

38. A method as defined in claim 37 wherein said step of controlling the flow of hydraulic fluid into and out of said bearing blocks comprises the steps of:

providing a pair of hydraulic cylinders corresponding to each said bearing block, each said pair of hydraulic cylinders comprising a piston rod slidably engaged between said pair of cylinders; and simultaneously controlling the movement of each said piston rod such that when said piston rod is moved in one direction hydraulic fluid will be injected from one of said hydraulic cylinders into said corresponding bearing block and such that when said piston rods are simultaneously moved in a second direction opposite to said first direction hydraulic fluid will be expelled from each said bearing block and returned to one of said pair of hydraulic cylinders.

39. In a roller conveyor for automatically sorting items according to size as said items are carried by said conveyor, a method for hydraulically adjusting the space between each pair of adjacent rollers on said conveyor comprising the steps of:

slidably mounting the ends of each said roller to the sides of a frame such that said rollers may be slidably positioned along the sides of said frame;

hydraulically connecting the ends of each pair of adjacent rollers such that the space between each pair of adjacent rollers is selectively increased or decreased in one of a plurality of modes, said modes comprising (a) adjusting all of the rollers at once by a uniform amount, (b) adjusting all of the rollers at once by uniformly increasing or decreasing the spacing between adjacent rollers from one end to the other, and (c) adjusting the spacing between one pair of rollers independently of the spacing between any other pair of rollers; and individually hydraulically actuating the ends of said rollers on both sides of said conveyor so as to simultaneously slide the ends of each said roller along the sides of said frame in order to selectively adjust the size of each said space between each said pair of adjacent rollers.

40. A method as defined in claim 39 wherein said roller conveyor further comprises a pair of bearing blocks for supporting each said roller at opposite ends thereof, each said bearing block comprising means for slidably engaging the sides of said frame and each adjacent pair of bearing blocks comprising a connecting rod slidably mounted between each pair of adjacent pair of bearing blocks, and wherein said step of hydraulically actuating the ends of said rollers comprises the step of controlling the flow of hydraulic fluid into and out of said bearing blocks such that when hydraulic fluid is injected into said bearing blocks said connecting rods will slide said bearing blocks further apart, and such that when hydraulic fluid is expelled from said bearing blocks said connecting rods will slide said bearing blocks closer together.

41. A method as defined in claim 40 wherein said step of controlling the flow of hydraulic fluid into and out of said bearing blocks comprises the step of simultaneously controlling the flow of hydraulic fluid into said bearing blocks on each side of said conveyor such that the bearing blocks on one side side of said conveyor will be actuated to move in the same direction and by the same amount of distance as the bearing blocks on the other side of said conveyor.

42. A method as defined in claim 40 wherein said step of controlling the flow of hydraulic fluid into and out of said bearing blocks comprises the steps of:

providing a pair of hydraulic cylinders corresponding to each said bearing block, each said pair of hydraulic cylinders comprising a piston rod slidably engaged between said pair of cylinders;

simultaneously controlling the movement of each said piston rod such that when said piston rod is moved in one direction hydraulic fluid will be injected from one of said hydraulic cylinders into said corresponding bearing block and such that when said piston rods are simultaneously moved in a second direction opposite to said first direction hydraulic fluid will be expelled from each said bearing block and returned to one of said pair of hydraulic cylinders.

43. A method as defined in claim 41 wherein said step of controlling the flow of hydraulic fluid into and out of said bearing blocks further comprises the steps of:

providing a drive rod connected to each said piston rod by a pin engaged to said drive rod; and hydraulically actuating movement of said drive rod so as to impart movement in one of said first and second directions to each said piston rod.

44. A method as defined in claim 43 wherein said step of hydraulically actuating said drive rod comprises the step of independently actuating each end of said drive rod so as to impart varying degrees of movement in one of said first and second directions to each said piston rod, whereby said bearing blocks are simultaneously positioned so that the open spaces between each adjacent pair of rollers will change in size from one end of said roller conveyor to the other by a uniformly graduated increment.

45. An apparatus for sorting products according to size comprising:

a roller conveyor for transporting products placed on said roller conveyor from one end thereof to the other, said roller conveyor comprising:

a pair of side members; and a plurality of rollers; and means for hydraulically controlling the position of each said roller, said means for hydraulically controlling the position of each said roller comprising:

a bearing block mounted at each end of each said roller on opposite sides of said roller conveyor, each said bearing block comprising means for slidably engaging said side members such that said bearing blocks can be slidably positioned along said side members, said bearing block comprising an interior bore formed therein for receiving hydraulic fluid; and means for hydraulically actuating each said bearing block so as to cause said bearing blocks to be selectively positioned either closer together or farther apart, said means for hydraulically actuating each said bearing block comprising a connecting rod positioned between each adjacent pair of bearing blocks such that one end of said connecting rod is slidably positioned inside the interior bore of one of said adjacent bearing blocks, and the other end of said connecting rod is nonslidably engaged in the interior bore of the other said adjacent bearing block.

46. A roller conveyor for automatically sorting items according to size as said items are carried by said conveyor, said roller conveyor comprising:

a plurality of rollers spaced one from the other, said rollers transporting a portion of said items from one end of said conveyor to the other end as said items roll across said rollers, another portion of said items being automatically sorted according to size as they fall between the spaces between said rollers;

a frame comprising side members for supporting said rollers at the ends of said rollers;

bearing means for slidably mounting the ends of each said roller to said side members;

connecting means for adjustably spacing each pair of adjacent bearing means, said connecting means comprising:

first means for selectively injecting hydraulic fluid into said bearing means such that when hydraulic fluid is injected into said bearing means said connecting means will urge said bearing means further apart; and second means for selectively expelling hydraulic fluid from said bearing means such that when hydraulic fluid is expelled from said bearing means said connecting means will force said bearing means to slide closer together; and means for hydraulically actuating each said connecting means such that the spacing between each adjacent pair of bearing means may be selectively adjusted to increase or decrease said spacing.

47. In a roller conveyor for automatically sorting items according to size as said items are carried by said conveyor, a method for hydraulically adjusting the spacing between each pair of adjacent rollers on said conveyor comprising the steps of:

rotatably mounting the ends of each said roller to a bearing block;

slidably mounting the ends of each said bearing block to the sides of a frame such that said bearing blocks and their respective rollers may be slidably positioned along the sides of said frame;

mounting a connecting rod between adjacent pairs of bearing blocks, at least one of said pair of bearing blocks having a bore for slidably receiving said connecting rod;

hydraulically actuating said bearing blocks by controlling the flow of hydraulic fluid into and out of said bearing block bore such that when hydraulic fluid is injected into said bearing block bore said connecting rods will slide said bearing blocks further apart, and such that when hydraulic fluid is expelled from said bearing block bore said connecting rods will slide said bearing blocks closer together said hydraulically actuating said bearing blocks selectively adjusting the size of each said space between each said pair of adjacent rollers.

* * * * *

UNITED STATES PATENT AND TRADEMARK OFFICE

CERTIFICATE OF CORRECTION

PATENT NO. : 4,627,541

DATED : December 9, 1986

INVENTOR(S) : Lynn F. Johnson

It is certified that error appears in the above-identified patent and that said Letters Patent is hereby corrected as shown below:

Col. 4, line 66, "accesed" should be --accessed--

Col. 6, line 64, "shown in best" should be --shown best--

Col. 15, line 14, "betwen" should be --between--

Col. 17, line 67, delete "side", second occurrence

Col. 20, line 26, delete "said hydraulically actuating" and insert --,-- therefor

Signed and Sealed this

Twenty-eighth Day of April, 1987

*Attest:*

DONALD J. QUIGG

*Attesting Officer*

*Commissioner of Patents and Trademarks*